US008151671B2

(12) United States Patent
Chen

(10) Patent No.: US 8,151,671 B2
(45) Date of Patent: Apr. 10, 2012

(54) TOOL ADAPTOR

(76) Inventor: Hui-Chien Chen, Dali (TW)

( * ) Notice: Subject to any disclaimer, the term of this patent is extended or adjusted under 35 U.S.C. 154(b) by 361 days.

(21) Appl. No.: 12/552,251

(22) Filed: Sep. 1, 2009

(65) Prior Publication Data

US 2011/0048180 A1 Mar. 3, 2011

(51) Int. Cl.
*B25B 23/16* (2006.01)

(52) U.S. Cl. ..... 81/177.75; 403/57; 464/119

(58) Field of Classification Search ..... 81/177.75, 81/177.7, 177.8, 177.85; 403/57, 100, 102; 464/119

See application file for complete search history.

(56) References Cited

U.S. PATENT DOCUMENTS 1,643,855 A * 9/1927 Peterson ..... 81/177.75

* cited by examiner

*Primary Examiner* — Debra S Meislin

(57) ABSTRACT

The tool adaptor of the present invention includes a first work piece, a second work piece and a block element. The work pieces are pivoted with each other. The block element is sleeved on the first work piece and slidable between a first position and a second position. As the block element locates at the second position, it engages with the first and second work pieces simultaneously to restrict the sway of the first work piece about the second work piece. The tool adaptor is therefore switchable between a swayable mode and a fixation mode by moving the block element between such positions.

10 Claims, 6 Drawing Sheets

TOOL ADAPTOR

BACKGROUND OF THE INVENTION

1. Field of the Invention

The present invention relates to a tool adaptor that has a swayable mode and a fixation mode.

2. Description of the Prior Art

A conventional universal tool adaptor can be used to mechanically connect two objects with two different axial directions. Generally, a conventional universal tool adaptor has a first part universally swayable about a second part thereof.

SUMMARY OF THE INVENTION

The main object of the present invention is to provide a tool adaptor that the sway of a first work piece about a second work piece can be selectively restricted.

To achieve the above object, a tool adaptor is provided. The tool adaptor includes a first work piece and a second work piece. The first and second work pieces are pivoted by a pivoting axle. The first work piece is swayable about the second work piece. A block element is sleeved on the first work piece and slidable between a first position and a second position. The block element abuts against the first and second work pieces simultaneously as the block element locates at the second position, restricting the sway of the first work piece about the second work piece. The block element is tube-shaped and has a first opening and a second opening communicating with each other. The second opening mounts the second work piece as the block element locates at the second position. The second work piece has a mounting portion laterally extending therefrom. The mounting portion has a configuration corresponding to the second opening to be selectively received in the second opening.

By sliding the block element to the first position or the second position, the tool adaptor of the present invention has a swayable mode and a fixation mode for the user to easily choose from.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
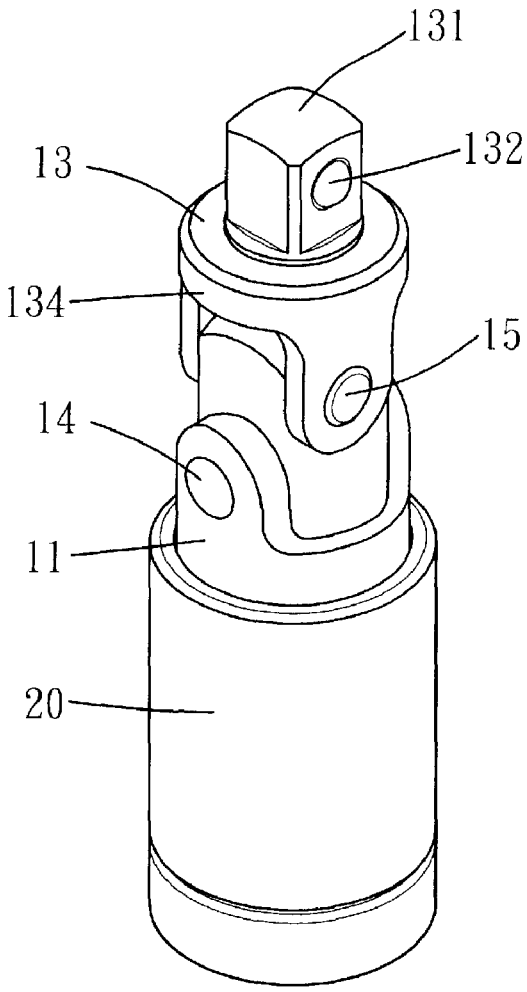
FIG. 1 is a drawing showing a tool adaptor in a swayable mode in accordance with a preferred embodiment of the present invention.
Figure 2:
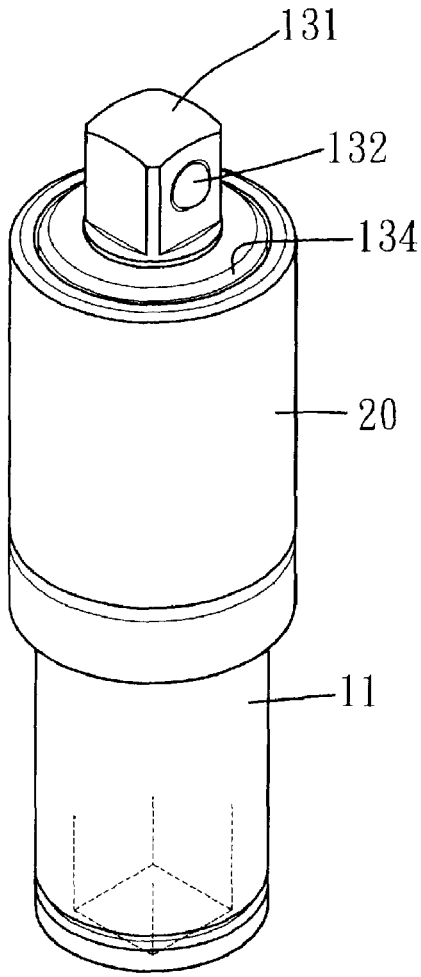
FIG. 2 is a drawing showing a tool adaptor in a fixation mode in accordance with a preferred embodiment of the present invention.
Figure 3:
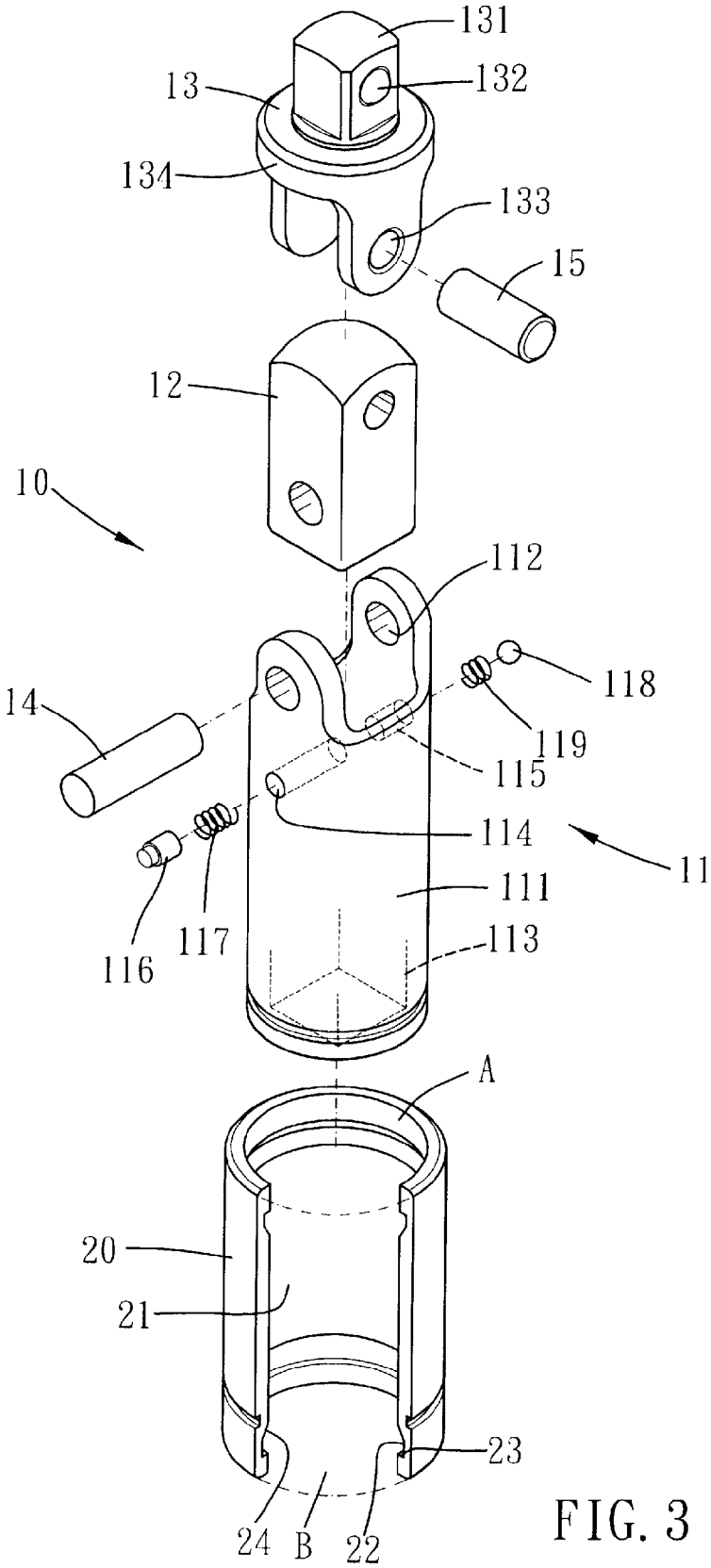
FIG. 3 is an explosive drawing showing a tool adaptor in accordance with a preferred embodiment of the present invention.

Please refer to FIG. 1 to 3 for a first embodiment of the present invention. A tool adaptor includes a working portion 10 and a block element 20. The working portion 10 includes a first work piece 11, a connecting shank 12 and a second work piece 13. The first work piece 11 has pole-shaped portion 111 for the block element 20 to sleeve thereon. Two axial bores 112 are disposed on a portion of the first work piece 11 extending from one of the work piece's 11 end, and a first driving portion 113 is disposed on another end of the work piece 11. In the present embodiment, the first driving portion 113 is a rectangular hole for a tool head to engage therewith. A first receiving bore 114 and a second receiving bore 115 are disposed on the pole-shaped portion 111 of the work piece 11. A positioning body 116 is installed in the first receiving bore 114, and a spring 117 abuts against the positioning body 116 and the first receiving bore 114 at two ends thereof to push the positioning body 116 to selectively protrude from an outer periphery of the work piece 11. An abutting body 119 is installed in the second receiving bore 115, and a resilient body 19 is disposed between the abutting body 119 and the receiving bore 115. The second work piece 14 has a second driving portion 131, which is a rectangular pole in the present embodiment, disposed on its one end, and an engaging ball 132 is disposed on a side surface of the second driving portion 131. The second work piece 13 further has two axial bores 133 disposed on a portion extending from another end of the work piece 13. A mounting portion 134 laterally extends from a portion of the second working piece 13 between the second driving portion 131 and the axial bores 133. The connecting shank 12 and the first work piece 11 are pivoted by a first pivoting axle 14 which pierces through the axial bores 112, and the connecting shank 12 and the second work piece 13 are pivoted by a second pivoting axle 15 which pierces through the axial bores 133. Orientations of the pivoting axles 14, 15 are not parallel, and they are preferably perpendicular to each other. As such, the connecting shank 12 and the work pieces 11, 13 are mechanically connected, and the first work piece 11 is two-directionally swayable about the second work piece 13.

As shown in FIG. 3, the block element 20 has an inner surface 21 that defines a first opening A and a second opening B communicating with the first opening A. The block 20 is sleeved on the first work piece 11 and is slidable between a first position and a second position. The inner surface 21 contacts at least a part of the first work piece 11 all the time and the inner surface 21 further contacts the second work piece 13 as it locates at the second position. A positioning groove structure to be engaged with the positioning body 116 is disposed between the first work piece 11 and the block element 20. In the present embodiment, the positioning groove structure includes two annular positioning grooves 22 spaced disposed on the inner surface 21. Each annular positioning groove 22 has an inner side wall 24 and an outer side wall 23, in which the inner side wall 24 is close to another positioning groove 22, and the outer side wall 23 is away from the another positioning groove 22. Each outer side wall 23 is perpendicular to the inner surface 21, and each inner side wall 24 makes an obtuse angle to the inner surface 21. Therefore, each annular positioning groove 22 has a trapezoid profile.

Figure 4:
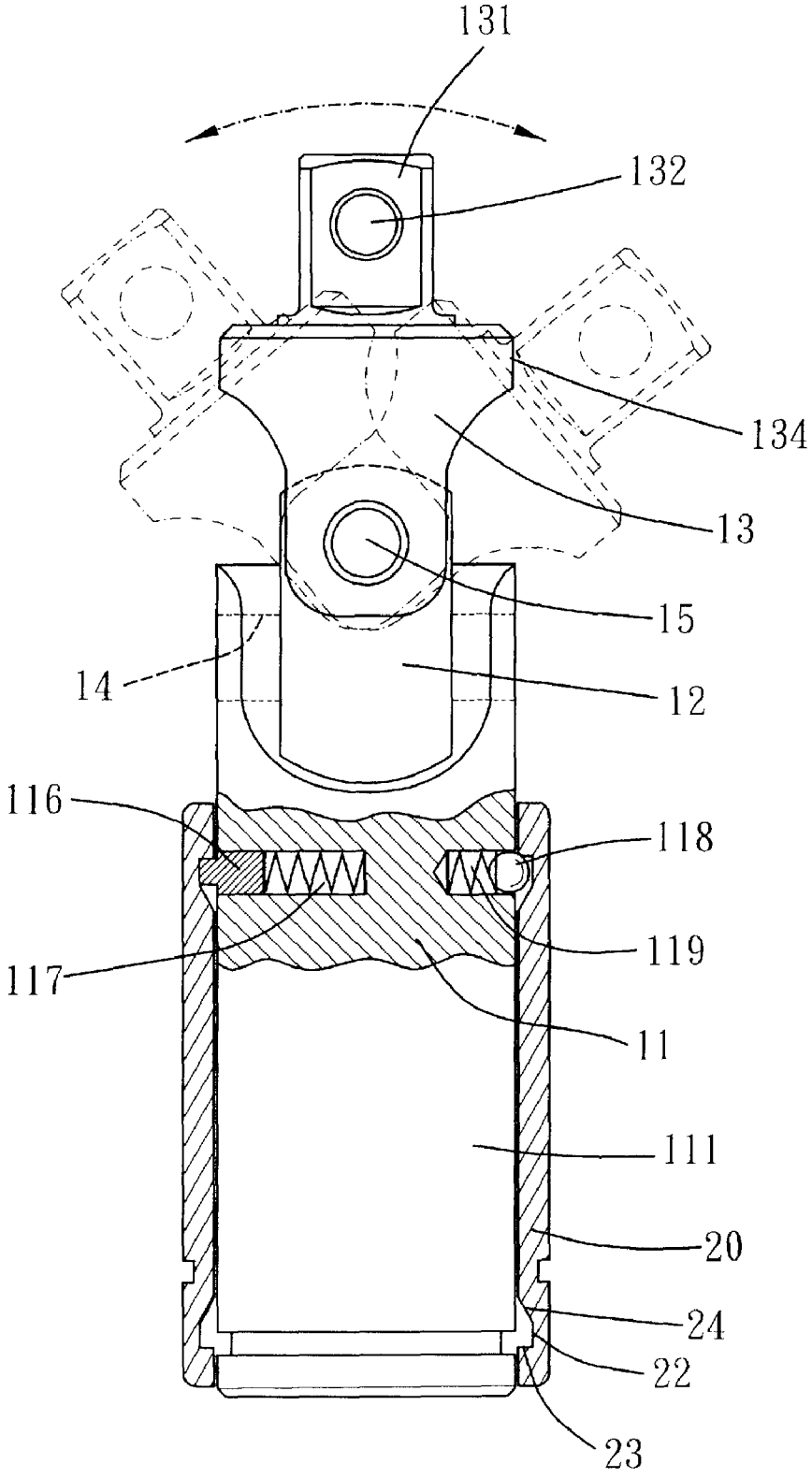
FIG. 4 is a profile of a tool adaptor in a swayable mode in accordance with a preferred embodiment of the present invention.
Figure 5:
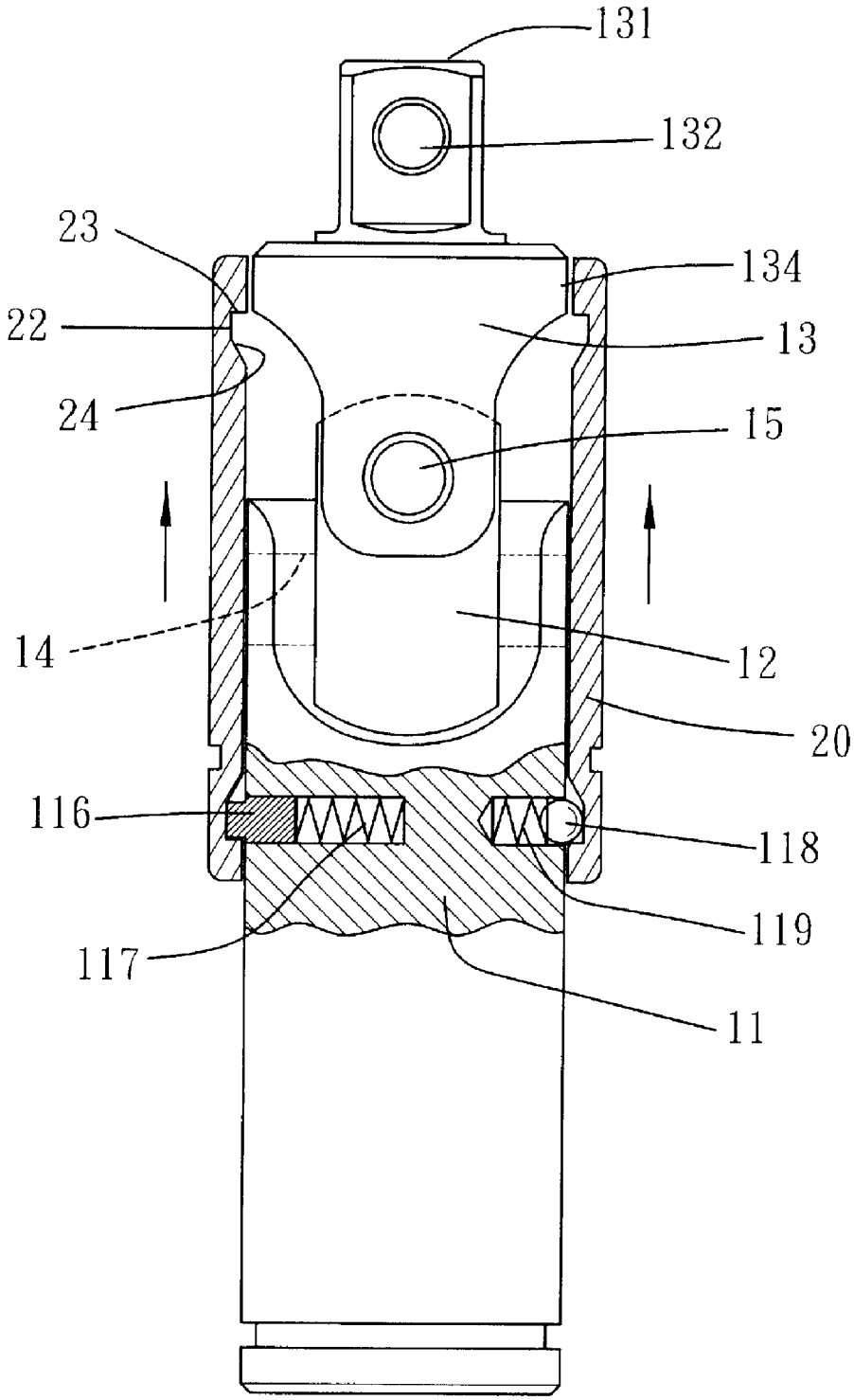
FIG. 5 is a profile of a tool adaptor in a fixation mode in accordance with a preferred embodiment of the present invention.

Refer to FIGS. 1 and 4. As the block element 20 locates at the first position, the inner surface 21 only contacts the first work piece 11. Therefore, the connecting shank 12 and the second work piece 13 can freely sway about the first work piece 11. In other words, the tool adaptor is in the swayable mode. Refer to FIGS. 2 and 5. As the block element 20 locates at the second position, the first opening A of the block element 20 still receives a part of the first work piece 11 therein, and the second opening B receives the mounting portion 134 of the second work piece 13 therein. Because the mounting portion 134 has a configuration substantially corresponding to the second opening B, the relative movement of the work pieces 11, 13 is therefore limited and the sway of the first work piece 11 about the second work piece 13 is restricted. That is to say, the tool adaptor is in the fixation mode.

In order to make the block element 20 slide smoothly, the block element 20 is made tube-shaped, and the configuration of the mounting portion further corresponds to the pole-shaped portion 111.

As shown in FIGS. 4 and 5, the block element 20 is slidable between the first position and the second position. The positioning body 116 can protrude from the outer periphery of the first work piece 11 to be received in one of the annular positioning groove 22 as the block element locates at the first position or the second position. Due to the perpendicular outer wall 23 of the positioning groove 22, the travel of the block element 20 is limited within the first and second positions since the positioning body 116 will be stopped by one of the outer wall 23. While the block element 20 sliding from one position to the other, the positioning body 116 is pushed toward an interior of the first receiving bore 114 by the inclined inner side wall 24 and the inner surface 21. The positioning body 116 is then held in the first receiving bore 114 until it meets a positioning groove 22 again. As such, the block element 20 can be easily pushed to slide without exceeding the travel between the first and second positions, and the block element 20 can be further held exactly at such positions due to the engagement of the positioning body 116 and the positioning groove structure. Nevertheless, the positioning groove structure may be designed to have a longitudinal groove disposed along the axial direction of the block element instead to limit the travel of the block element 20.

Due to abutment of the abutting body 118 against the block element 20, the block element 20 and the first work piece 11 can, therefore, tightly contact with each other and slide without stiffness.

Figure 6:
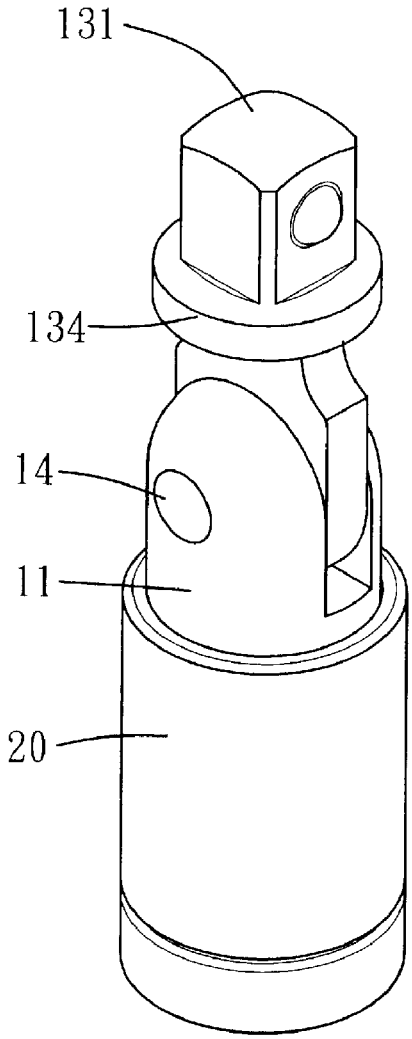
FIG. 6 is a drawing showing a tool adaptor in a swayable mode in accordance with another preferred embodiment of the present invention.
Figure 7:
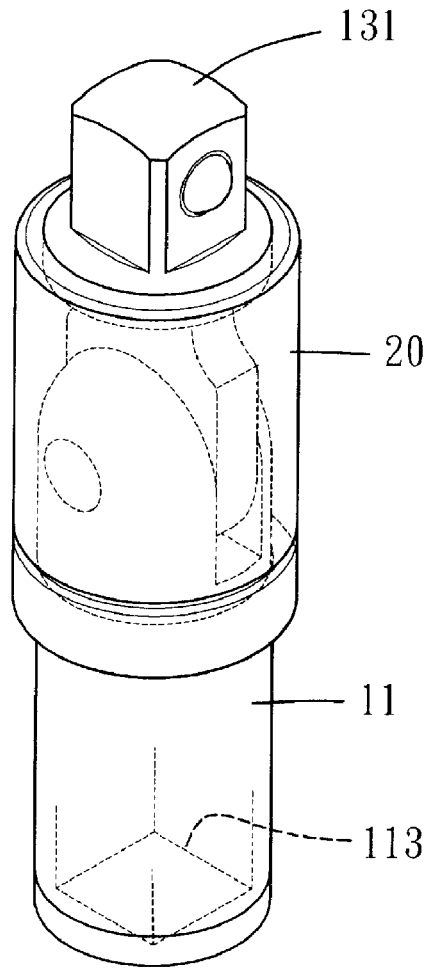
FIG. 7 is a drawing showing a tool adaptor in a fixation mode in accordance with another preferred embodiment of the present invention.

Please refer to FIGS. 6 and 7 for the second embodiment of the present invention. A tool adaptor may be made without a connecting shank connecting between the first and second work pieces 11, 13, i.e. the first and second work pieces 11, 13 directly pivot with each other by a single pivoting axle 14. The first work piece 11 is still swayable about the second work piece 13 as the block element 20 locates at the first position. Also, the sway of the first work piece 11 is restricted as the block element 20 locates at the second position to engage with the mounting portion 134.

Figure 8:
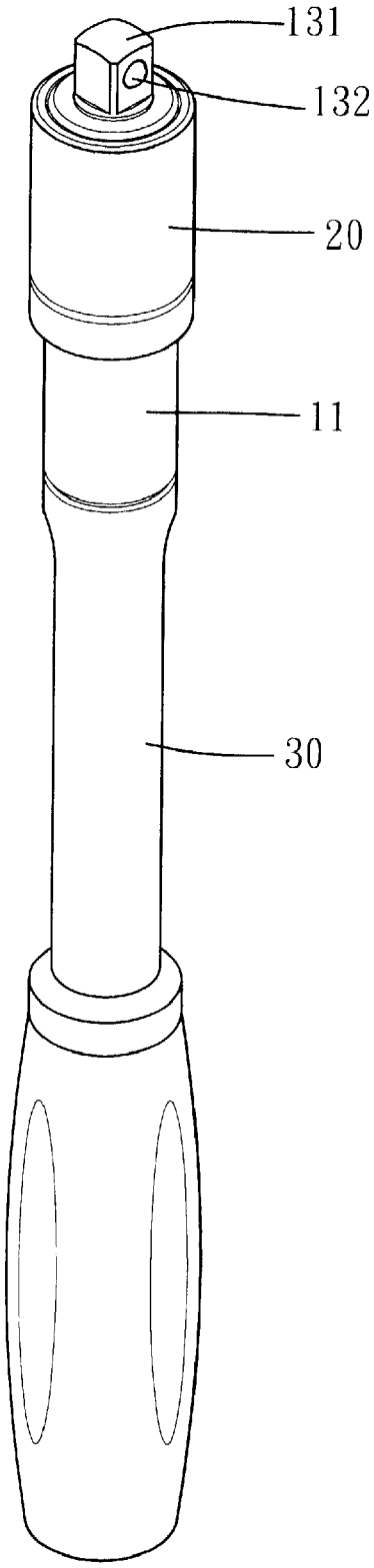
FIG. 8 is a drawing showing a tool adaptor in accordance with yet another preferred embodiment of the present invention.

The driving portions 113, 131 can be designed to have other geometric or non-geometric configurations. Or, the driving portions 113, 131 can also be a handle 30 to be held by the user, as shown in FIG. 8.

In summary, the tool adaptor has two usage modes, i.e. a swayable mode and a fixation mode, for the user to choose from. When the tool adaptor is in the swayable mode, the block element is at the first position to enable the first work piece to sway about the second work piece. When the tool adaptor is in the fixation mode, the block element is at the second position to restrict the sway of the first work piece. The switch of mode is simply done by moving the block element along the travel between the first and second positions, in which the block element can be further fixed at desired position by the engagement of the positioning body and the positioning groove structure.

What is claimed is:

1. A tool adaptor, comprising a first work piece and a second work piece, the first and second work pieces being pivoted by a pivoting axle, the first work piece being swayable about the second work piece, a block element being sleeved on the first work piece and slidable between a first position and a second position, the block element abutting against the first and second work pieces simultaneously as the block element locates at the second position, restricting the sway of the first work piece about the second work piece;

wherein the block element is tube-shaped, the block element has a first opening and a second opening communicating with each other, the second opening mounts the second work piece as the block element locates at the second position;

wherein the second work piece has a mounting portion laterally extending therefrom, the mounting portion has a configuration substantially corresponding to the second opening to be selectively received in the second opening;

wherein a positioning body and a positioning groove structure are disposed between the block element and the first work piece, the positioning body is engageable with the positioning groove structure to limit the travel of the block element within the first and second positions;

wherein the block element has an inner surface contacting the first work piece, the positioning groove structure includes two annular positioning grooves spaced disposed on the inner surface, each annular positioning groove has an inner side wall close to the other annular positioning groove and has an outer side wall away from the other annular positioning groove, each outer side wall is perpendicular to the inner surface, each inner side wall makes an obtuse angle to the inner surface, each annular positioning groove has a profile being trapezoid, the positioning body is disposed on the first work piece and selectively protrudes from an outer periphery of the first work piece to be received in one of the annular positioning groove as the block element locates at the first position or the second position.

2. The tool adaptor of claim 1, wherein an abutting body is disposed on the first work piece, a resilient body is disposed between the abutting body and the first work piece to push the abutting body to constantly abut against the inner surface of the block element, so that the block element and the first work piece tightly contact with each other.

3. The tool adaptor of claim 1, wherein a first driving portion is disposed on a distal end of the first work piece, a second driving portion is disposed on a distal end of the second work piece.

4. The tool adaptor of claim 3, wherein the first driving portion is a handle.

5. The tool adaptor of claim 3, wherein the second driving portion is a handle.

6. A tool adaptor, comprising a first work piece, a second work piece and a connecting shank, the connecting shank and the first work piece being pivoted by a first pivoting axle, the connecting shank and the second work piece being pivoted by a second pivoting axle, an orientation of the first pivoting axle being perpendicular to that of the second pivoting axle, so that the first work piece being two-directionally swayable about the second work piece, a block element being sleeved on the first work piece and slidable between a first position and a second position, the block element abutting against the first and second work pieces simultaneously as the block element locates at the second position, restricting the sway of the first work piece about the second work piece;

wherein the block element is tube-shaped, the block element has a first opening and a second opening communicating with each other, the second opening mounts the second work piece as the block element locates at the second position;

wherein the second work piece has a mounting portion laterally extending therefrom, the mounting portion has a configuration substantially corresponding to the second opening to be selectively received is the second opening;

wherein a positioning body and a positioning groove structure are disposed between the block element and the first work piece, the positioning body is engageable with the positioning groove structure to limit the travel of the block element within the first and second positions;

wherein the block element has an inner surface contacting the first work piece, the positioning groove structure includes two annular positioning grooves spaced disposed on the inner surface, each annular positioning groove has an inner side wall close to the other annular positioning groove and has an outer side wall away from the other annular positioning groove, each outer side wall is perpendicular to the inner surface, each inner side wall makes an obtuse angle to the inner surface, each annular positioning groove has a profile being trapezoid, the positioning body is disposed on the first work piece and selectively protrudes from an outer periphery of the first work piece to be received in one of the annular positioning groove as the block element locates at the first position or the second position.

7. The tool adaptor of claim 6, wherein an abutting body is disposed on the first work piece, a resilient body is disposed between the abutting body and the first work piece to push the abutting body to constantly abut against the inner surface of the block element, so that the block element and the first work piece tightly contact with each other.

8. The tool adaptor of claim 6, wherein a first driving portion is disposed on a distal end of the first work piece, a second driving portion is disposed on a distal end of the second work piece.

9. The tool adaptor of claim 8, wherein the first driving portion is a handle.

10. The tool adaptor of claim 8, wherein the second driving portion is a handle.

* * * * *